US005469122A

United States Patent [19]

Yoon

[11] Patent Number: 5,469,122

[45] Date of Patent: Nov. 21, 1995

[54] DEFLECTION YOKE

[75] Inventor: In J. Yoon, Suwon, Rep. of Korea

[73] Assignee: Samsung Electro-Mechanics Co., Ltd., Suwon, Rep. of Korea

[21] Appl. No.: 173,762

[22] Filed: Dec. 27, 1993

[30] Foreign Application Priority Data

Dec. 30, 1992 [KR] Rep. of Korea ..... 92-26405

[51] Int. Cl.[6] ..... H01H 1/00; H01J 29/06; H01J 1/52; H01J 29/56

[52] U.S. Cl. ..... 335/214; 315/370; 315/8; 315/85

[58] Field of Search ..... 335/210–214; 315/370, 8, 85

[56] References Cited

U.S. PATENT DOCUMENTS

| | | | |
|---|---|---|---|
| 4,788,470 | 11/1988 | Kohzuki | 313/440 |
| 4,853,588 | 8/1989 | Ohtsu | 313/440 |
| 4,914,350 | 4/1990 | Bosch | 315/8 |
| 4,922,167 | 5/1990 | Sluyterman | 313/431 |
| 5,189,348 | 2/1993 | Yokota | 315/399 |
| 5,317,239 | 5/1994 | Ohguro | 315/370 |

OTHER PUBLICATIONS

National Technical Report, vol. 38, No. 4 Aug. 1992 pp. 35–41.

*Primary Examiner*—Leo P. Picard
*Assistant Examiner*—Stephen T. Ryan
*Attorney, Agent, or Firm*—Ladas & Parry

[57] ABSTRACT

A deflection yoke has an induction coil wrapped about its ferrite core at an angle of from 0 to 70 degrees from the horizontal axis of the deflection yoke to supply current to a leakage magnetic-field canceling coil also mounted to the deflection yoke for attenuating a leakage magnetic field produced from the front, rear and side of a cathode ray tube within the deflection yoke without using a separate circular core. This improves the operation and simplifies the production of the deflection yoke as compared to deflection yokes having the leakage magnetic-field canceling coil serially connected to the horizontal deflection coil or using a separate circular core.

8 Claims, 6 Drawing Sheets

DEFLECTION YOKE

BACKGROUND OF THE INVENTION

1. Field of the Invention

The present invention relates to a deflection yoke, and more particularly to a deflection yoke mounted in a large-sized television for attenuating a leakage magnetic field occurring around a cathode ray tube as well as the front and rear portions thereof by means of a horizontal deflection coil, wherein an induction coil adjacent to the horizontal deflection coil is wound around a ferrite core to directly induce horizontal deflection current applied from the horizontal deflection coil to a leakage magnetic-field canceling coil, so that the leakage magnetic field is attenuated without affecting the sensitivity of the deflection yoke, and production efficiency is improved by designing the leakage magnetic-field canceling coil to be automatically wound.

DESCRIPTION OF THE PRIOR ART

In general, as shown in FIG. 1, a deflection yoke 1 mounted to a cathode ray tube (CRT) (not shown) for a television monitor or the like has a pair of coil separators 4 and 5 for a neck portion and a screen portion, and a pair of horizontal and vertical deflection coils 2 (FIG. 4) and 3 respectively wound around the inner and outer sides of the pair of coil separators 4 and 5. Also, a pair of ferrite cores 6 are mounted about the CRT, fixed by a clamp 7 and wrapped by the vertical deflection coil 3.

The deflection yoke 1 is mounted to the neck portion of the CRT, and, once a sawtooth pulse is supplied to the horizontal and vertical deflection coils 2 and 3, a magnetic field is generated in conformity with a Fleming's rule of left hand, so that red, green and blue electron beams R, G and B emitted from an electron gun are deflected by the influence of the magnetic force, thereby forming a picture.

In typical low-resolution monitors and small-sized televisions, the horizontal and vertical deflection coils 2 and 3 are supplied with current having a relatively low frequency, e.g., 15.75 KHz for the horizontal deflection coil 2 and 60 Hz for the vertical deflection coil 3.

Due to the current flowing through the horizontal and vertical deflection coils 2 and 3 of the deflection yoke 1 a leakage magnetic field M1 as shown in FIG. 2 is produced from the inside of the CRT to the outside thereof. The leakage magnetic field M1 is mainly generated from the horizontal deflection coil 2 having the higher frequency, but even the frequency applied to the horizontal deflection coil 2 is relatively low and the amount of the leakage magnetic field M1 is so small as to be negligible.

However, in case of the deflection yoke 1 for a high definition color monitor or a large-sized television, high current having a frequency of more than 31 KHz is supplied and the leakage magnetic field M1 becomes increased. The very low frequency magnetic field band of the leakage magnetic field M1 cannot exceed, however, a predetermined quantity that is an international security standard, i.e., MPR II Rule. This stipulates the quantity to be below ten to hundreds of nanotesla nT at a location spaced apart from the CRT by 50 cm.

The conventional construction of the deflection yoke now will be further described with reference to FIGS. 3A to 9.

Referring to FIG. 3, a pair of leakage magnetic-field canceling coils 8 (both shown in FIG. 5) wound as a vertically-elongated rectangle are installed on both sides of the screen portion 5 of the coil separator to produce a magnetic field in the direction opposite to that of the leakage magnetic field M1 (FIG. 2), which is elongated up and down from the front to rear portion (Y axis in FIG. 11) of the CRT screen when caused by the horizontal deflection coil 2 of the deflection yoke 1. The pair of leakage magnetic-field canceling coils 8 are parallel with the Y-axis of the deflection yoke 1, i.e., the front and rear portions of the screen, and are serially connected to the horizontal deflection coil 2.

When the electron beams are deflected toward the left in FIG. 3A, the current applied to the horizontal deflection coil 2 generates the magnetic field M1 from the top down toward the bottom of the screen portion 5 of the coil separator, as shown in FIG. 5. Meanwhile, an attenuation magnetic field M2 from the leakage magnetic-field canceling coil 8 is generated in the direction opposite to the leakage magnetic field M1 from the horizontal deflection coil 2 to interlink the leakage magnetic field M1.

The leakage magnetic-field canceling coil can attenuate the leakage magnetic field, but it is serially connected to the horizontal deflection coil, so that an inductance value at the horizontal end of the deflection yoke is increased to degrade a sensitivity (i.e., a deflection precision of the electron beams with respect to current) of the deflection yoke.

Therefore, since there is a limitation on the increase in the number of turns of the leakage magnetic-field canceling coil without affecting the product characteristics such as the sensitivity of the deflection yoke, the conventional deflection yoke has a problem of impeding effective elimination of the leakage magnetic field in the CRT.

Moreover, if the inductance value at the horizontal end of the deflection yoke should be constantly maintained regardless of the presence of the leakage magnetic-field canceling coil, the number of turns of the horizontal deflection coil must be decreased complementarily to the inductance of the leakage magnetic-field canceling coil.

However, the sensitivity in the horizontal end of the deflection yoke is varied with or without attaching the leakage magnetic-field canceling coil. Thus, as illustrated in FIGS. 6A and 6B, the landing characteristic of the electron beams B is varied by approximately 5 to 10 μm with respect to pixels P. In more detail, without attaching the leakage magnetic-field canceling coil, the electron beams B scanning the screen are as shown in FIG. 6A; with attaching it, they are as shown in FIG. 6B, thereby causing the mislanding that the electron beams B scanning the screen toward the center of the screen with respect to pixels P horizontally away from the center. Consequently, a separate operation is required for improving the mislanding phenomenon at a lot of cost and time in manufacturing the deflection yoke.

Furthermore, by serially-connecting the horizontal deflection coil and the leakage magnetic-field canceling coil, an unstable waveform A appears on the peak portion of the pulse (refer to FIG. 7A) supplied to the leakage magnetic-field canceling coil owing to stray capacity of the leakage magnetic-field canceling coil. This unstable waveform A causes light and dim stripes on the left side of the picture as illustrated in FIG. 7B. The appearance of the stripes is called a ringing phenomenon. In order to prevent the ringing phenomenon, as shown in FIG. 4, a resistor R and a capacitor C are connected in parallel with the leakage magnetic-field canceling coil. The resistor and capacitor raise manufacturing cost.

In order to solve the above-described problems the Toshiba Co. of Japan has developed a deflection yoke as illustrated in FIGS. 8A, 8B, 8C and 9, in which an additional circular core 9 has a primary side connected to the horizontal deflection coil 2' and a secondary side connected to the leakage magnetic-field canceling coil 8'. The rectangular leakage magnetic-field canceling coil 8' is not serially connected to the horizontal deflection coil 2'. Instead, one place on the circular core 9 is wound twice or thrice by an induction coil 10 twice or thrice on for extraction from the horizontal deflection coil 2, and induction coils 11 for extraction to the leakage magnetic-field canceling coil 8' are wound twice or thrice around the circular core 9 at two places.

In this case, the horizontal deflection current applied to the horizontal deflection coil 2 is also supplied to the induction coil 10 to thereby magnetize the circular core 9. A magnetic field M3 from the magnetized circular core 9 is thus applied to the induction coil 11, which is connected to the leakage magnetic-field canceling coil 8' to supply a constant current to the leakage magnetic-field canceling coil 8', which in turn generates an attenuation magnetic field by the supplied current to attenuate the leakage magnetic field. By using the circular core without serially connecting the leakage magnetic-field canceling coil to the horizontal deflection coil, the current induced from the horizontal deflection coil is supplied to energize the leakage magnetic-field canceling coil, so that the interrelation of the horizontal end of the deflection yoke with the operation of the leakage magnetic-field canceling coil is decreased, and the inductance at the horizontal end of the deflection yoke is constantly maintained to attenuate the leakage magnetic field without affecting the inherent characteristics of sensitivity and landing of the deflection yoke.

Although the deflection yoke mounted with the leakage magnetic-field canceling coil using the circular core can decrease the time required for manufacturing the deflection yoke, because the landing characteristic of the deflection yoke is not changed by the presence of the leakage magnetic-field canceling coil, a separate medium (e.g., the circular core 9) must be used for supplying the induction current from the horizontal deflection coil to the leakage magnetic-field canceling coil, thereby adding other components and reducing the production efficiency.

Also, although preventing the unstable waveform A on the peak portion of the pulse (refer to FIG. 7A) supplied to the leakage magnetic-field canceling coil appearing due to a residual capacitance of the leakage magnetic-field canceling coil, which is caused by serially connecting the horizontal deflection coil and the leakage magnetic-field canceling coil, the leakage magnetic field can be attenuated without greatly affecting the ringing phenomenon. But the quantity of the leakage magnetic field generated from the horizontal deflection coil in the case of a large-sized television becomes so much as to require an increase in the number of turns of the induction coil wound on the primary side of the circular core.

In other words, if the strength of leakage magnetic field is increased, the strength of the attenuation magnetic field also should be increased to counteract the leakage magnetic field. In order to increase the strength of the attenuation magnetic field, the number of turns of the induction coil coiled on the primary side of the circular core is increased for inducing the horizontal deflection current from the deflection yoke to the leakage magnetic field.

As a result, by the increase of the number of turns of the induction coil wound around the primary side of the circular core, the sensitivity of the deflection yoke is affected to regenerate the problem that had been caused by serially connecting the horizontal deflection coil to the leakage magnetic-field canceling coil and prompted the attempt of the circular core in the first place.

Further, the method for winding the induction coil around the circular core cannot use a winding machine as used for winding the horizontal and vertical deflection coils in the deflection yoke. For example, in a saddle-toroidal deflection yoke, a separate ferrite core is fixed and then the vertical deflection coil is wound while turning the winding machine, but the circular core is not separately provided to make a manufacturer directly wind the induction coil on the circular core.

Accordingly, the processing for winding respective induction coils on the circular core is very complicated and fastidious, which obstructs the automation of the manufacturing process, thereby degrading production efficiency.

SUMMARY OF THE INVENTION

The present invention is devised to solve the above-described problems. Therefore, it is an object of the present invention to provide a deflection yoke capable of effectively attenuating a leakage magnetic field and improving production efficiency through an automation of its manufacturing process, without affecting the inherent characteristics such as sensitivity of the deflection yoke mounted in a large-sized television.

To achieve the above object of the present invention, there is provided a deflection yoke which includes a coil separator with a neck portion and a screen portion, and horizontal and vertical deflection coils provided on the inner and outer portions of the coil separator, ferrite cores mounted to wrap the vertical deflection core, and leakage magnetic-field canceling coils fixed on the screen portion of the coil separator for generating an attenuation magnetic field to attenuate a leakage magnetic field from the horizontal deflection coil. Here, the deflection yoke especially has induction coils connected to the leakage magnetic-field canceling coil and adjacently provided with the horizontal deflection coil, so that induce horizontal deflection current is directly induced from the horizontal deflection coil for applying the induction current to the leakage magnetic-field canceling coils.

Preferably, the induction coils are wound by a predetermined number of turns as wrapping the ferrite cores to be symmetrical in up-and-down and left-to-right directions within the range from 0 to 70 degrees with respect to a horizontal axis of the deflection yoke, and serially connected to the leakage magnetic-field canceling coil.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
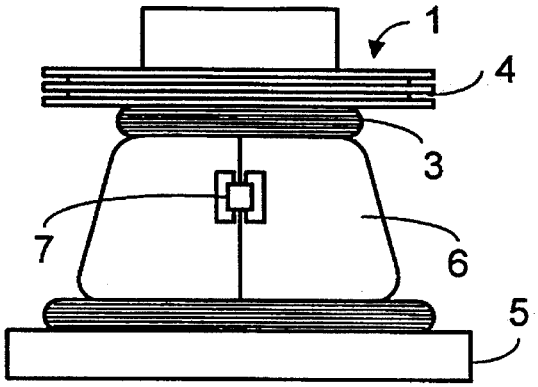
FIG. 1 PRIOR ART
FIG. 1 is a front view showing a general deflection yoke.
Figure 2:
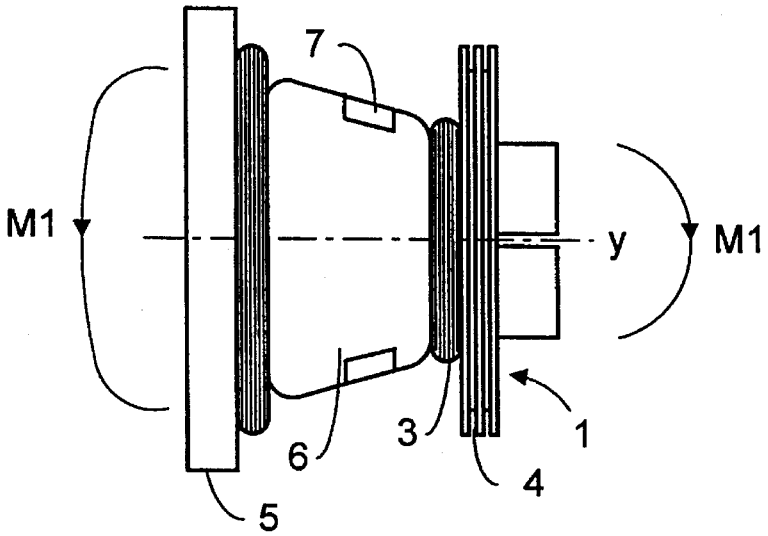
FIG. 2 PRIOR ART
FIG. 2 shows the generation of a magnetic field according to FIG. 1.
Figure 3A:
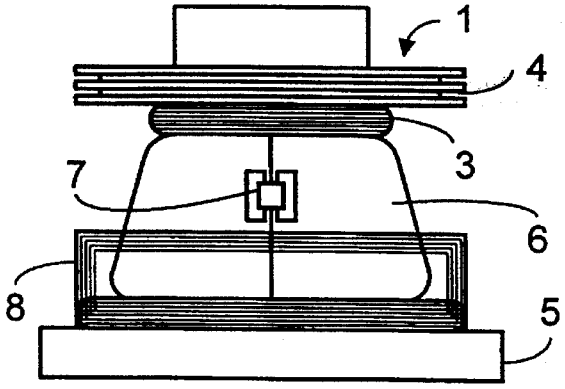
FIG. 3A PRIOR ART
FIGS. 3A and 3B are front and perspective views showing one embodiment of a deflection yoke mounted with a leakage magnetic-field canceling coil according to a conventional technique.
Figure 3B:
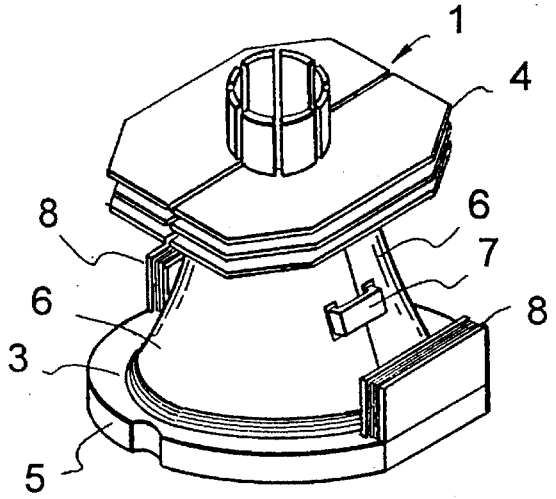
FIG. 3B PRIOR ART
Figure 4:
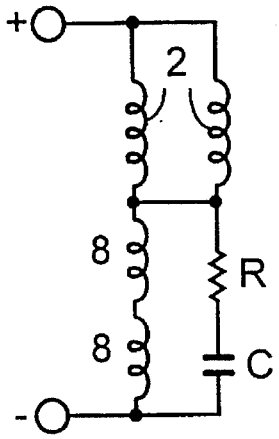
FIG. 4 PRIOR ART
FIG. 4 shows an equivalent circuit diagram of FIGS. 3A and 3B.
Figure 5:
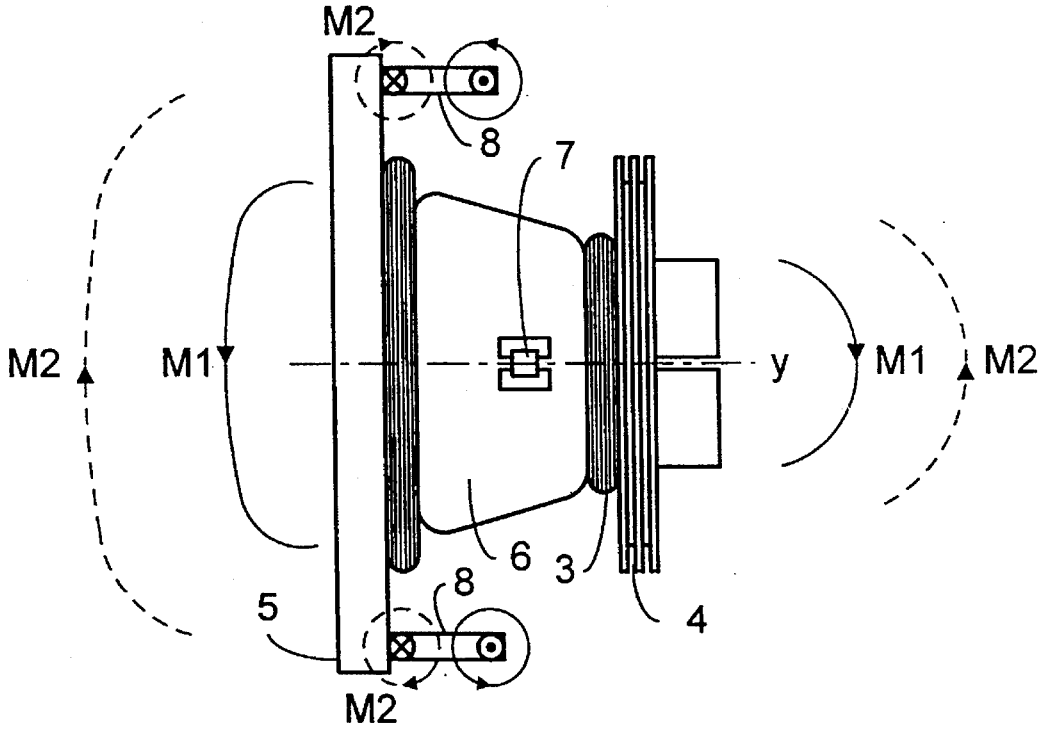
FIG. 5 PRIOR ART
FIG. 5 shows the generation of a magnetic field according to FIG. 3.
Figure 6A:
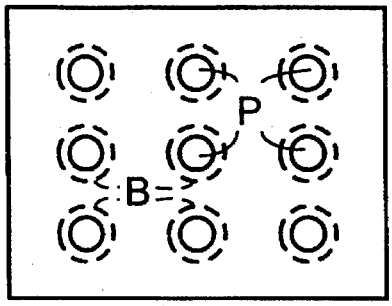
FIG. 6A PRIOR ART
FIG. 6A shows a characteristic view of a picture incorporated with landing before the leakage magnetic-field canceling coil is energized.
Figure 6B:
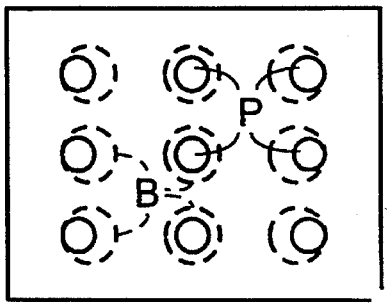
FIG. 6B PRIOR ART
FIG. 6B shows a characteristic view of a picture incorporated with landing after the leakage magnetic-field canceling coil is energized.
Figure 7A:
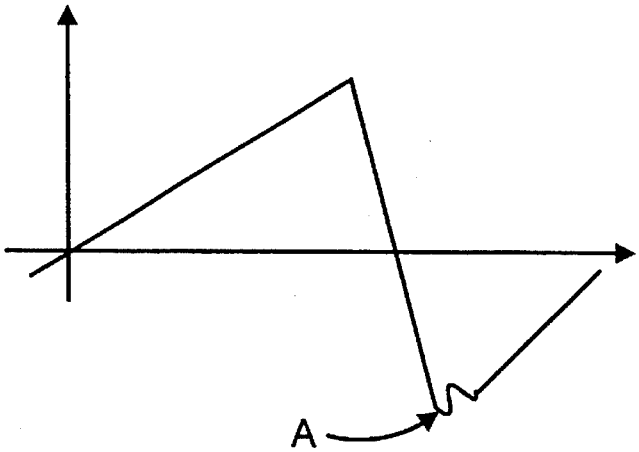
FIG. 7A PRIOR ART
FIG. 7A is a waveform showing pulses supplied to the horizontal deflection coil and the leakage magnetic-field canceling coil.
Figure 7B:
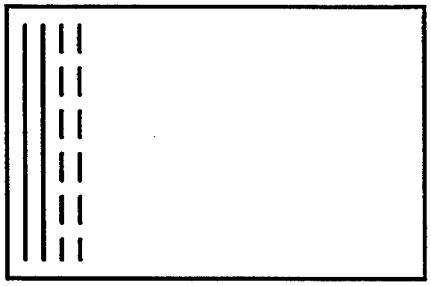
FIG. 7B PRIOR ART
FIG. 7B shows a characteristic view of a picture in which a ringing phenomenon occurs due to the pulses as shown in FIG. 7A.
Figure 8A:
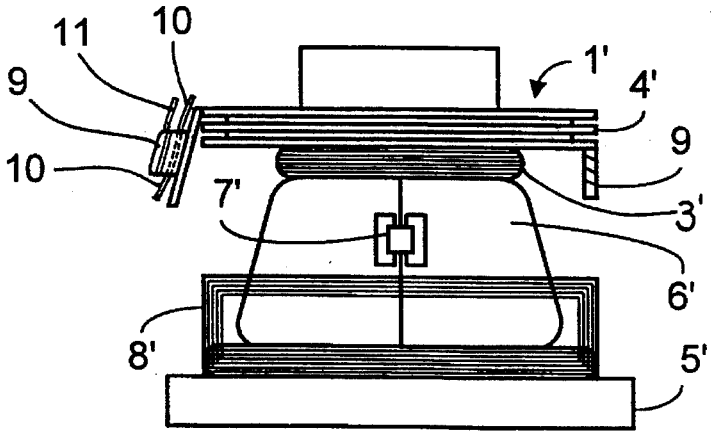
FIG. 8A PRIOR ART
FIGS. 8A, 8B and 8C are a front view, a schematic view and a perspective view respectively showing another embodiment of the deflection yoke mounted with the leakage magnetic-field canceling coil according to a conventional technique.
Figure 8B:
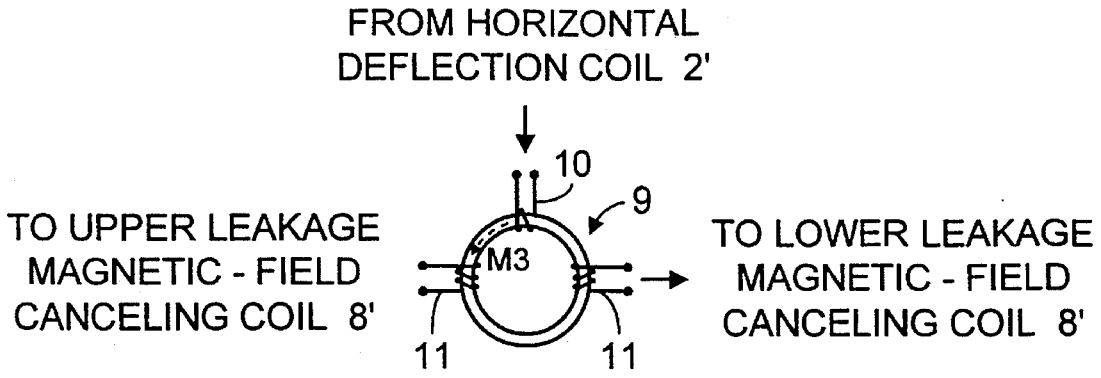
FIG. 8B PRIOR ART
Figure 8C:
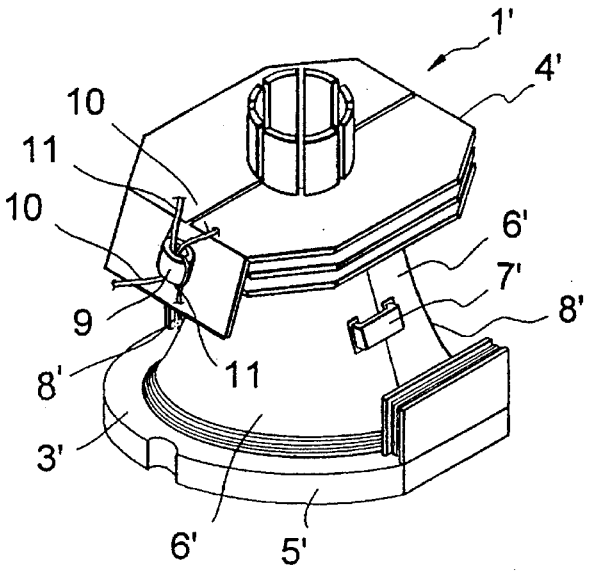
FIG. 8C PRIOR ART
Figure 9:
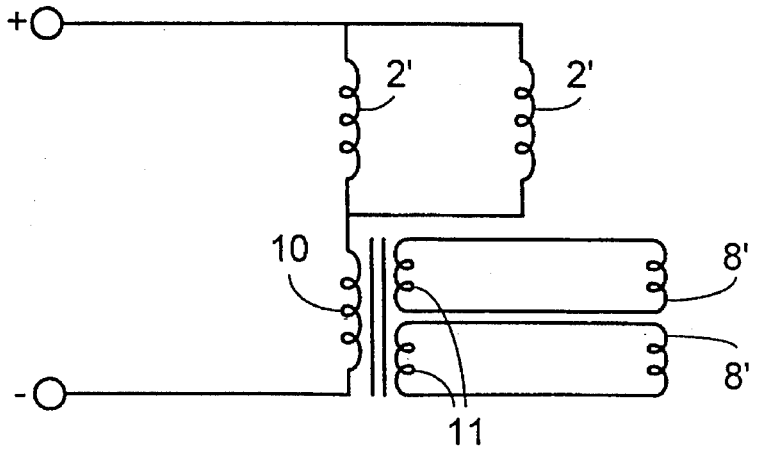
FIG. 9 PRIOR ART
FIG. 9 is an equivalent circuit diagram of FIG. 8.
Figure 10A:
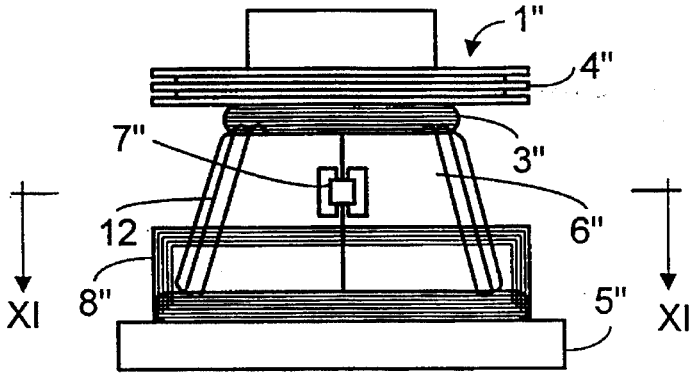
FIGS. 10A and 10B are front and perspective views showing one embodiment of a deflection yoke mounted with a leakage magnetic-field canceling coil according to the present invention.
Figure 10B:
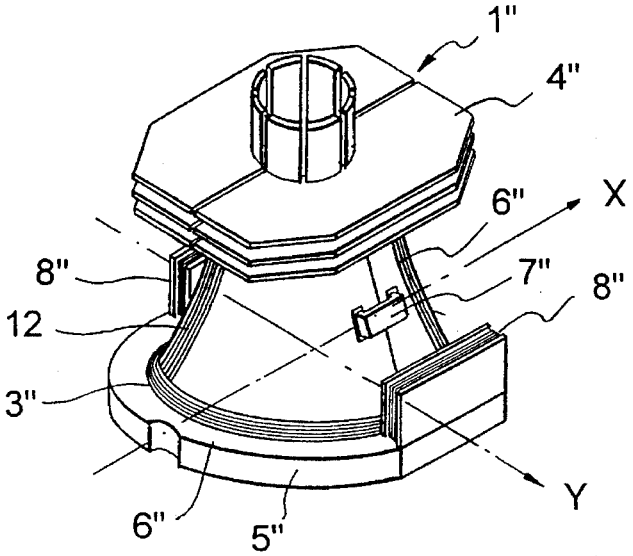

FIGS. 10A and 10B shows a saddle-saddle type deflection yoke according to the present invention, where the same reference numerals with double primes as shown in the FIG. 1 through FIG. 9 indicate the same parts.

Figure 12:
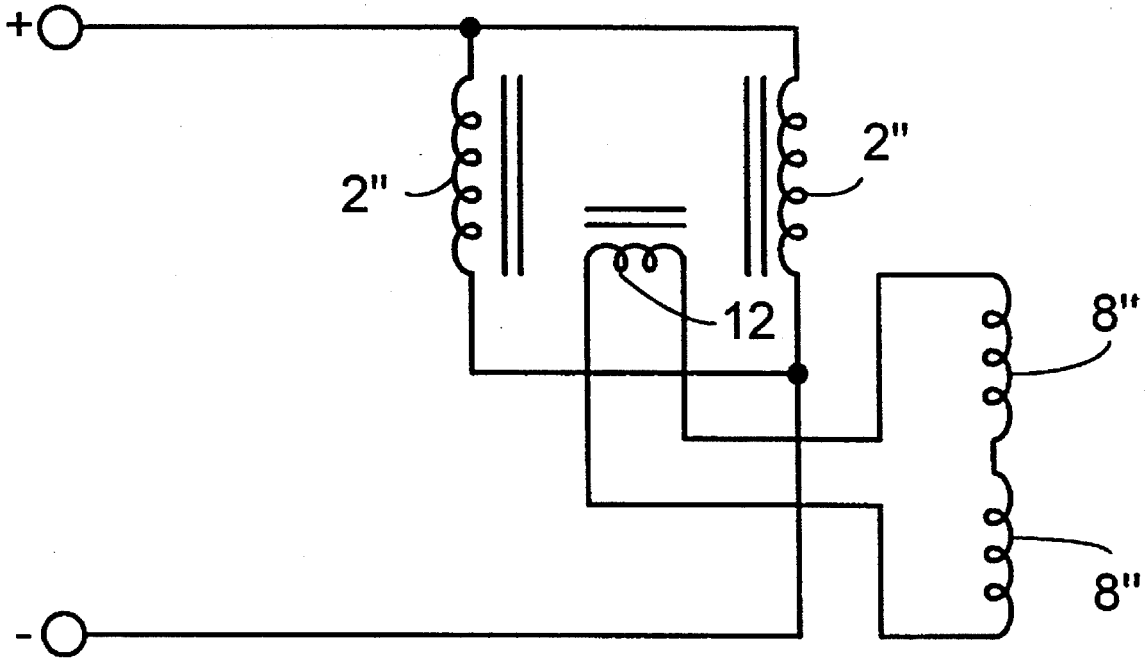
FIG. 12 is an equivalent circuit diagram of FIGS. 10A and 10B.

Here, a pair of horizontal and vertical deflection coils 2" (FIG. 12) and 3" (FIGS. 10A and 10B) wound as a saddle type are respectively mounted on the inner and outer sides of a screen portion 5" and a neck portion 4" of coil separators. A pair of ferrite cores 6" which are fixed by a core clamp 7 are provided to wrap the outer circumference of the vertical deflection coil 3".

On the upper and lower sides of the screen portion 5" of the coil separator are fixed a pair of rectangular leakage magnetic-field canceling coils 8" having a predetermined number of turns. An induction coil 12 having a predetermined number of turns, for example, from three to ten turns, is symmetrically coiled with respect to a horizontal axis, and is connected preferably serially (series) to the leakage magnetic-field canceling coil 8" (refer to FIGS. 11 and 12).

After the deflection yoke 1" constructed as above is mounted to the neck portion of the CRT, sawtooth pulses having a predetermined frequency of 31.5 kHz as the horizontal frequency and 60 Hz as the vertical frequency are applied to the horizontal and vertical deflection coils 2" and 3", respectively. This produces the horizontal and vertical deflection magnetic fields in accordance with Fleming's rule of left hand as mentioned above. Once the horizontal and vertical deflection magnetic fields are produced, R, G and B electron beams from an electron gun (not shown) are subjected to the deflection force formed by the magnetic field to be deflected to form a picture.

Figure 11:
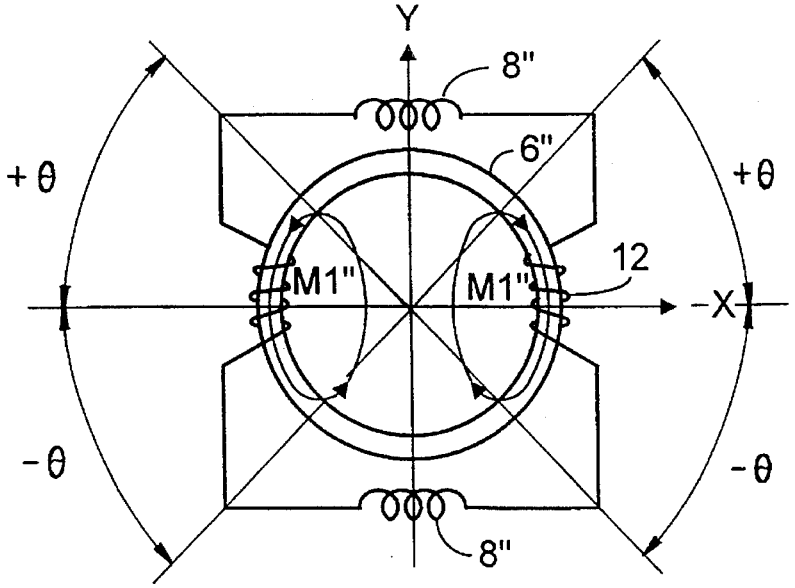
FIG. 11 is a sectional view showing the deflection yoke taken along line X1—X1 of FIG. 10.

At the same time the horizontal deflection coil 2" so generates the leakage magnetic field M1" in the front and rear directions as well as the side direction of the CRT with respect to the horizontal axis. The leakage magnetic field M1" of the horizontal deflection coil 2", as shown in FIG. 11, periodically induces voltage and current of a predetermined amount in the induction coil 12, so that a magnetic field is formed from the leakage magnetic-field canceling coil 8" in the opposite direction of the leakage magnetic field M1" produced by the horizontal deflection coil 2" to counteract with each other. Since this interaction has been described with reference to FIGS. 3 to 7, the detailed description thereof will be omitted.

Here, the induction voltage and current applied to the induction coil 12 can be written as:

$$Vi = -\frac{d\phi}{dt} = -N \times S \frac{dB}{dt} \quad \text{<Equation 1>}$$

where Vi denotes an induction electromotive force, Φ is a leakage magnetic field, N is the number of turns of an induction coil, S is a cross-sectional area of the induction coil, and B is magnetic flux density for interlinking the coil which forms a loop.

The induction current supplied to the leakage magnetic-field canceling coil 8" is coincident with a period of the current supplied to the horizontal deflection coil 2", and the induction voltage has a peak value during a fly-back period of the electron beams.

In a saddle-toroidal type deflection yoke, the induction coil would be coiled within the range from 20 to 70 degrees to be symmetrical with respect to a horizontal axis. This is because, in the saddle-toroidal type deflection yoke, the vertical deflection coil is wound after a plane on the horizontal axis is fixed by a fixing apparatus (not shown) called a core chuck. As a result the induction coil cannot be wound on the horizontal axis and is, instead around 45 degrees.

Consequently, according to the present invention, a separate component (i.e., the circular core 9 of FIGS. 8A, and 8C) is not formed but, instead, the induction coil 12 is wound around the previously-mounted ferrite core 6", thereby attenuating the leakage magnetic field as the conventional deflection yoke which uses the circular core. Not using the separate component reduces cost.

Moreover, using the ordinary method of coiling the vertical deflection coil for the induction coil simplifies the manufacturing operation.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. In a deflection yoke including a coil separator with a neck portion and a screen portion, horizontal and vertical deflection coils respectively provided on inner and outer portions of said coil separator, toroidal ferrite cores mounted to wrap said vertical deflection coil, and leakage magnetic-field canceling coils fixed on said screen portion of said coil separator for generating a magnetic field to attenuate a leakage magnetic field from said horizontal deflection coil, the improvement of said deflection yoke comprising:

induction coils not connected to said horizontal deflection coil but connected to said leakage magnetic-field canceling coil and adjacently provided at said horizontal deflection coil to directly induce horizontal deflection current from said horizontal deflection coil for said leakage magnetic-field canceling coils, and wherein said induction coils are wound continuously about inner and outer portions of said toroidal ferrite cores in directions between said neck and screen portions of said coil separator.

2. A deflection yoke as claimed in claim 1, wherein said induction coil is wound three to ten turns.

3. A deflection yoke as claimed in claim 1, wherein said induction coils comprise a first induction coil having opposite ends in a range of from −70 to +70 degrees of an X axis of said toroidal ferrite cores and a second induction coil symmetrical to the first induction coil with regard to a Y axis of said toroidal ferrite cores.

4. A deflection yoke as claimed in claim 3, wherein said induction coil is wound three to ten turns.

5. A deflection yoke as claimed in claim 3, wherein said induction coil is serially connected to said leakage magnetic-field canceling coil.

6. A deflection yoke as claimed in claim 2, wherein said induction coil is serially connected to said leakage magnetic-field canceling coil.

7. A deflection yoke as claimed in claim 4, wherein said induction coil is serially connected to said leakage magnetic-field canceling coil.

8. A deflection yoke as claimed in claim 1, wherein said induction coil is serially connected to said leakage magnetic-field canceling coil.

* * * * *